US006280051B1

(12) United States Patent
Wallach

(10) Patent No.: US 6,280,051 B1
(45) Date of Patent: Aug. 28, 2001

(54) COMBINATION FLASHLIGHT AND NIGHT LIGHT

(76) Inventor: Stewart Wallach, 1020 NW. 6th St. Plaza Bay B., Deerfield Beach, FL (US) 33442

( * ) Notice: Subject to any disclaimer, the term of this patent is extended or adjusted under 35 U.S.C. 154(b) by 0 days.

(21) Appl. No.: 09/293,857

(22) Filed: Apr. 16, 1999

(51) Int. Cl.[7] ..... F21L 7/00

(52) U.S. Cl. ..... 362/202; 362/96; 362/101; 362/208; 362/318; 362/86; 362/399; 362/400

(58) Field of Search ..... 362/96, 101, 208, 362/318, 86, 202, 399, 400

(56) References Cited

U.S. PATENT DOCUMENTS

| | | | | |
|---|---|---|---|---|
| 1,934,214 | | 11/1933 | Stimson . | |
| 1,995,141 | | 3/1935 | Barber . | |
| 2,082,857 | | 6/1937 | Thoroughgood et al. . | |
| 2,530,069 | | 11/1950 | Moore . | |
| 2,823,300 | | 11/1958 | Graubner . | |
| 3,877,171 | | 4/1975 | Sloop et al. . | |
| 4,072,855 | | 2/1978 | Marchese . | |
| 4,231,077 | | 10/1980 | Joyce et al. . | |
| 4,502,102 | | 2/1985 | Phipps . | |
| 4,858,083 | | 8/1989 | Wakimoto . | |
| 4,967,321 | | 10/1990 | Cimock . | |
| 5,105,343 | * | 4/1992 | Wakiimoto | 362/101 |
| 5,165,781 | * | 11/1992 | Orak | 362/101 |
| 5,272,604 | | 12/1993 | Lin . | |
| 5,476,406 | | 12/1995 | Cheng . | |
| 5,588,739 | * | 12/1996 | Nakao | 362/202 |
| 5,642,931 | * | 7/1997 | Gappelburg | 362/202 |
| 5,678,918 | | 10/1997 | Lin . | |
| 5,678,921 | * | 10/1997 | Kish et al. | 362/202 |
| 5,716,121 | * | 2/1998 | Dubois | 362/202 |
| 5,720,541 | | 2/1998 | Bayles . | |
| 5,816,688 | * | 10/1998 | Shui Shang | 362/263 |
| 6,039,453 | * | 3/2000 | Wang | 362/101 |
| 6,039,460 | * | 3/2000 | Ng et al. | 362/101 |
| 6,082,876 | * | 7/2000 | Hanson et al. | 362/202 |

* cited by examiner

*Primary Examiner*—Stephen Husar
*Assistant Examiner*—Anabel M. Ton
(74) *Attorney, Agent, or Firm*—Brinkley, McNerney, Morgan, Solomon & Tatum, LLP

(57) ABSTRACT

A novelty flashlight with a clear body. The front half is cone shaped and houses a light bulb, 2 AA batteries and a switch, and is covered with an attractive soft material. The rear half houses a liquid (e.g. water) and ornamental elements. An opaque cap is provided which, when placed over the front end of the flashlight, blocks light from escaping other than toward the rear end of the flashlight to illuminate the liquid and ornamental elements, acting as a nightlight for kids. The front end is surrounded by a reflective/opaque coating under the soft material. The bulb support, which is usually a reflective parabolically shaped piece in a typical flashlight, is transparent to allow light to pass backward into the rear end of the flashlight. Light is also conducted through the clear flashlight housing.

12 Claims, 5 Drawing Sheets

COMBINATION FLASHLIGHT AND NIGHT LIGHT

BACKGROUND OF THE INVENTION

1. Field of the Invention

This invention relates to the field of illumination, and more particularly relates to a combined apparatus for generating a focused beam of light, i.e. flashlight, and acting as an ornamental night light.

2. Description of the Related Art

Devices for generating and directing a focused beam of light, i.e. "flashlights", are well-known and documented. Although principally used under more serious circumstances such as search and rescue, during power outages, etc., novelty flashlights constitute a significant proportion of the overall flashlight market in this country.

Examples of previous versions of novelty flashlights are shown in U.S. Pat. No. 5,105,343 to Wakimoto; U.S. Pat. No. 4,858,083 to Wakimoto; and Des 267,045 to Lieberman et al. Wakimoto '343 teaches a novelty flashlight having a transparent body and a spherically-shaped decorative portion connected to the light-emitting end thereof. Not only does the decorative portion prevent the flashlight from being stood on its end so as to act as a night light, but the body thereof is virtually completely occupied by batteries and electronic circuitry such that no decorative material can be placed within the body. Wakimoto '083 discloses a color-changeable photo-decorative pencil torch, but which does not have a transparent body. Further, this device has a liquid containing receptacle containing liquid-suspended light-scattering members extending from the illuminated end of the flashlight such that the flashlight cannot be used for the primary function of a flashlight which emits a focused beam. Lieberman et al appears to disclose a flashlight having a first end in which is housed a light source, switch, etc., and a second end which contains a liquid with bubbles therein. However, no disclosure is made therein that there is any means for illuminating the second end of the flashlight.

Therefore, there exists a need for a flashlight and night light combination in which light from the flashlight end of the device can be highly efficiently conveyed to a second, ornamental, end thereof, where the device can be either stood on its end or the illuminated end capped to cause the intensification of the illumination of the second end.

SUMMARY OF THE INVENTION

It is, therefore, a principal object of this invention to provide a combination flashlight and night light utilizing a single light source.

It is also an object of this invention to provide a combination flashlight and night light in which the intensity of the night light feature is relatively strong.

It is a still further object of this invention to provide a combination flashlight and night light which employs a standard flashlight at one end and a decorative night light at the other end.

These and other objects are achieved by the provision of a novelty flashlight and night light combination which utilizes a transparent body member and unique light bulb cowl and bezel arrangement which causes light emitted by the flashlight to be both conducted through the transparent body member toward the second end thereof as well as radiated through the interior cavity of a first end of the flashlight toward a second end thereof to create an intense illumination of liquid or other matter contained in the second end of the flashlight. An opaque covering may be applied to the first end of the flashlight to reduce or eliminate light energy loss through the body at the first end of the flashlight. A bezel cover may be employed to further reduce or eliminate light loss through the first end of the flashlight.

In accordance with these and other objects which will become apparent hereinafter, the instant invention will now be described with particular reference to the accompanying drawings.

DETAILED DESCRIPTION OF THE INVENTION

Figure 1:
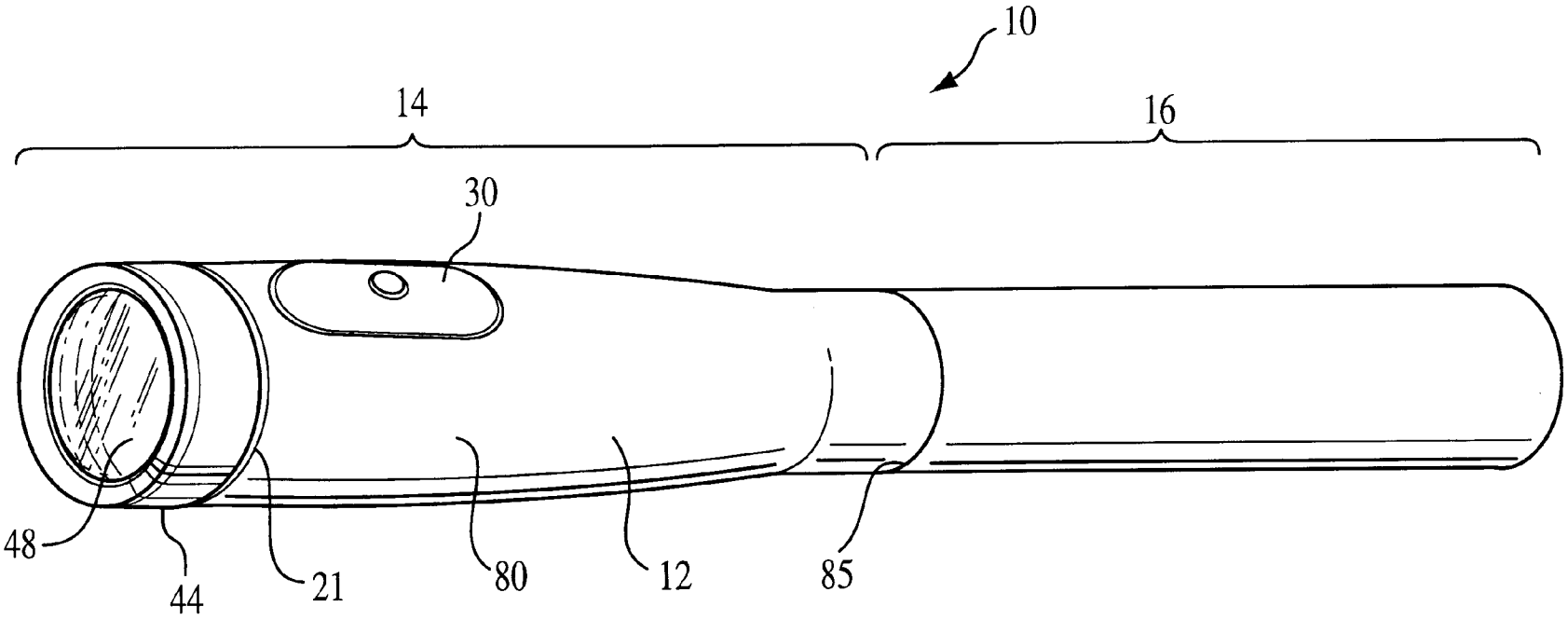
FIG. 1 is an assembled perspective view of the invention.

Referring now to the drawings, the combination flashlight and night light 10 is comprised of a unitary body member 12 having a first, flashlight, end 14 and a second, night light, end 16. In the preferred embodiment, both the first and second ends are constructed of a transparent material. However, the first end could be opaque or even translucent. Included in the flashlight end 14 is a hollow cavity 18 defined by interior walls 20 of the first end 14 adapted to house a power source such as batteries (not shown), a lamp 26, and electrically conductive strip 60 which complete an electric circuit through the lamp 26 and power source through a switch 30. The light is received in a socket 34 which in turn is connected to a transparent cowl 40. The transparent cowl 40 allows light from the bulb to radiate directly back into the second end of the body (which will be described in more detail below), as well as into the transparent body member at the first end of the flashlight, from where it is conducted within the body member toward the second end of the flashlight. A bezel 44 is connected to the upper most end of the first end 14 of the body 12 by screw threads 46, snap fit, or any other suitable means for connecting.

Figure 2:
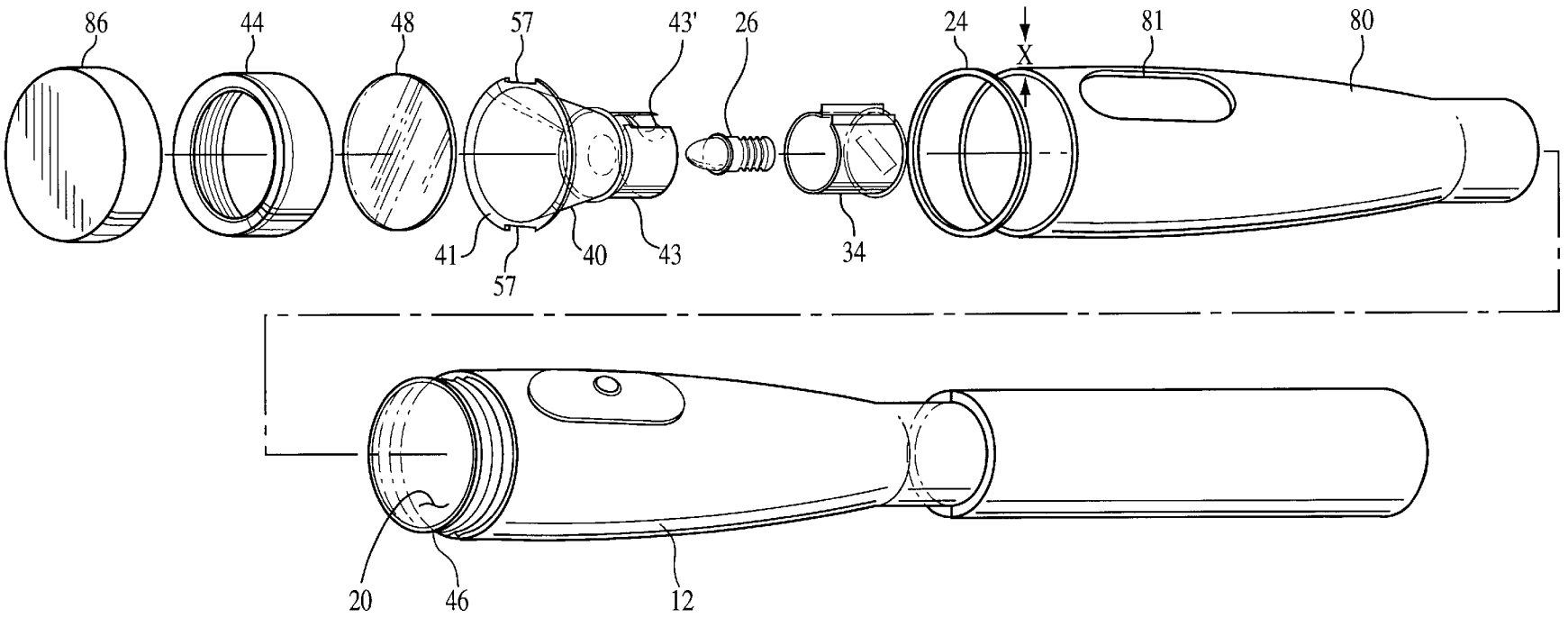
FIG. 2 is an exploded perspective view of the invention.
Figure 3:
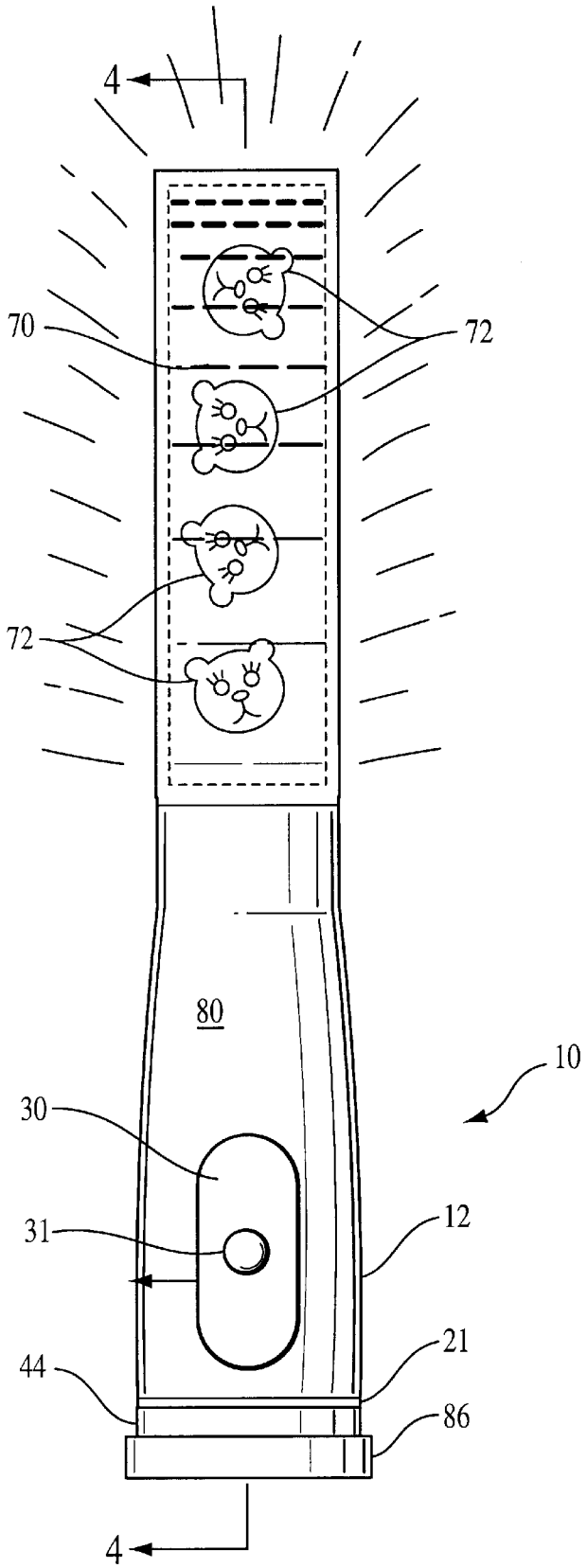
FIG. 3 is an assembled elevational view of the invention.
Figure 4:
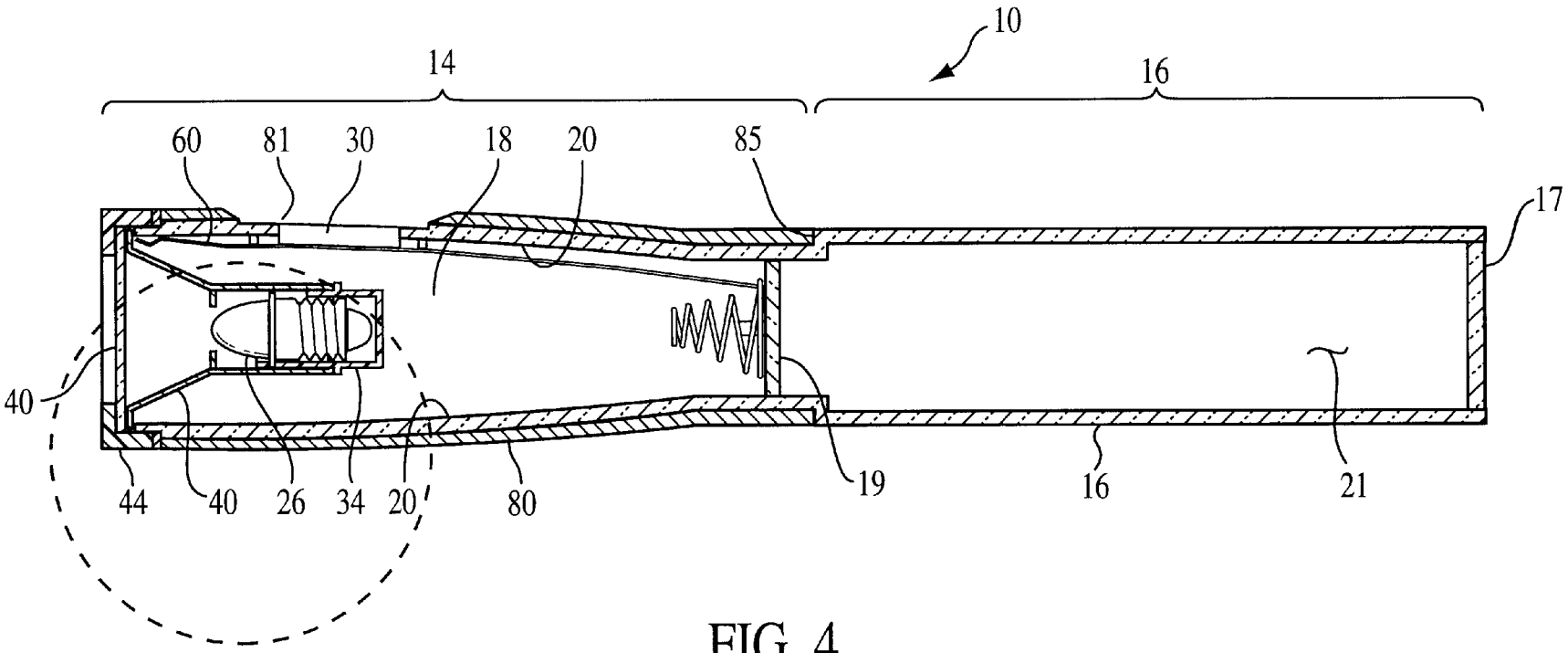
FIG. 4 is a cross-sectional elevational view of the invention taken through lines 4—4 of FIG. 3.
Figure 5:
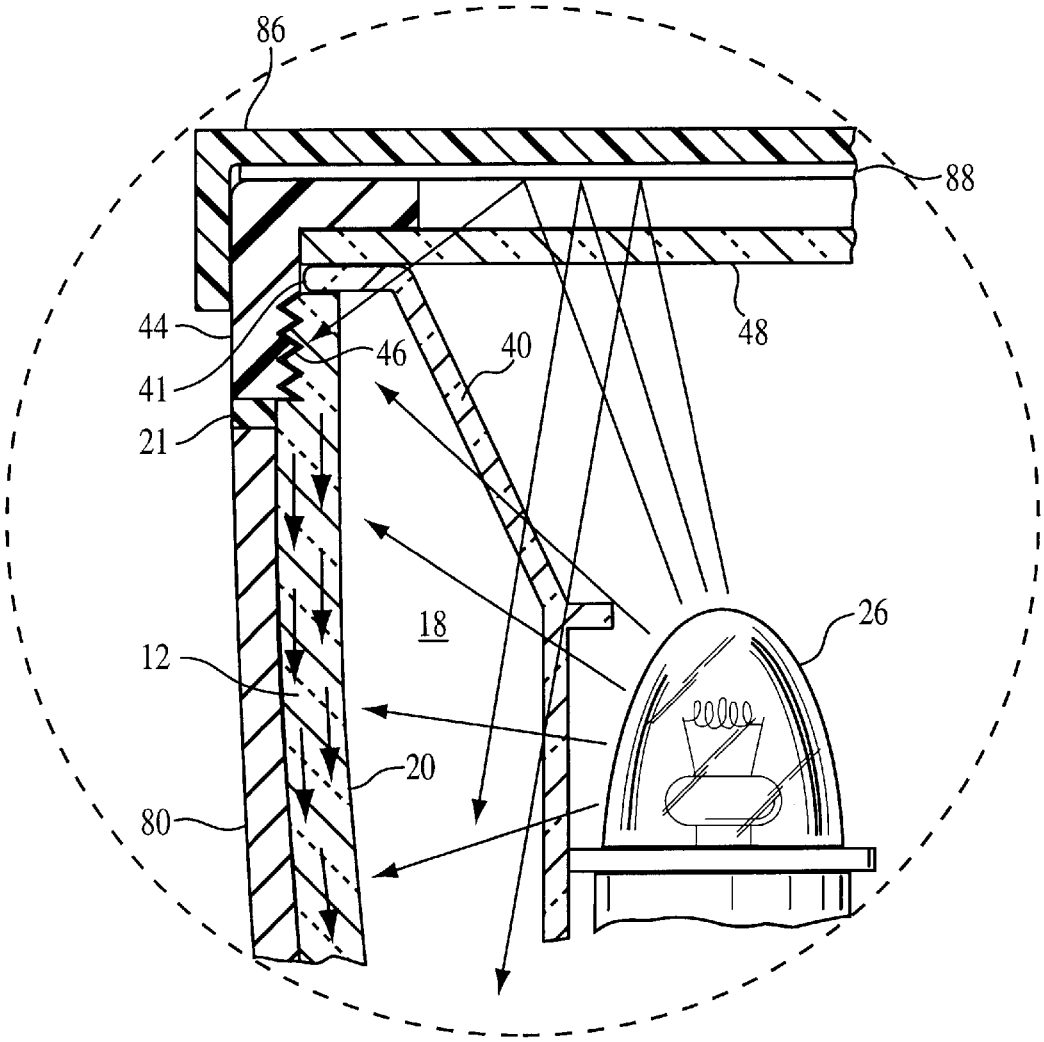
FIG. 5 is a close-up of the area of detail circled in FIG. 4.

As best seen in FIGS. 2 and 4–5, a lens member 48 is sandwiched between the bezel 44 and cowl 40. The cowl may be releasably connected to the interior of the bezel by tabs 55 on the interior of bezel 44 and corresponding notches 57 in a flange 41 of the cowl. A washer, o-ring or other sealing means may be used to seal the bezel against the upper end of the body member.

The electric circuit includes a conductive strip 60 connected to a metallic spring or other biasing member at the bottom of the hollow cavity 18 in the first end 14 of the body member. The spring is adapted to receive the power source, such as a battery or batteries, in compressive relation thereupon. The conductive strip may be split by on/off switch 30, and connected to a conductive portion of the lamp 26 by a conductive ring 43 and tab 43' arrangement connected to the cowl 40. It is to be understood that any known apparatus for creating light energy is contemplated and the particular structure shown in the drawings is only an example and is not intended to limit the scope of the invention.

The second end 16 of the body member is water-tight and is filled with a material 70 which may be any decorative matter such as colored or clear pellets, sand, etc. If liquid is used, it may be of any suitable specific gravity and viscosity. The liquid may have a plurality of small reflective or otherwise ornamental items 72 suspended therein to enhance the visual/aesthetic appeal of the device. An end plug 17 is fixedly and sealingly secured to the lower most (i.e. distal) end of the body cavity to sealingly retain the liquid in the hollow second end 16 of the flashlight body.

An opaque covering 80 may be placed over all or a portion of the first end 14 of the body 12 so as to constrain light within the first end of the body from radiating outwardly therefrom and consequently to cause such light to be conducted toward the second end of the flashlight. This effect can be further realized by the utilization of an opaque bezel and o-ring, which leaves the light energy with no path of travel but toward the second end of the light. By making the covering 80 of a rubberized or otherwise resilient material, the tactile character of the device is improved. A cutout 81 is provided in covering 80 to expose on/off switch 30.

To further decrease light loss through the first end of the flashlight when the device is used as a night light, an opaque bezel cover 86 is employed which fits over the bezel snugly. The cap may be provided with a reflective film 88 covering its lens-facing surface 89 so as to increase the light energy which is directed toward the second end of the flashlight body.

Body 12 is preferably constructed of a single piece of transparent plastic such as Lucite® or any other transparent, light transmissive material. A barrier member or plate 19, which is preferably transparent, is sealingly connected at an upper most (i.e. proximal) end of the second end 16 of the body 12 to provide a sealed chamber 21 in which material 70 is housed.

An annular shoulder 85 may be provided at the upper most end of second end 16 of the housing 12 corresponding generally to the thickness "x" of covering 80 so as to provide a generally streamlined shape and feel to the exterior of the flashlight 10.

It is to be noted that the first end 14 of the housing may be flared, and hence of an enlarged diameter, so as to permit light from lamp 26 to pass through transparent cowl 40 and be transmitted/radiated through the hollow inner cavity 18 of the first end 14 of body 12. This light energy both passes through transparent plate 19 and enters chamber 21, illuminating material 70, and also passes through the inner surface 20 of housing 12 and is conducted toward the second end 16 of the body 12. When cover 86 is placed upon bezel 44, the opacity of the cover and bezel cause light energy from lamp 26 to be radiated and conducted exclusively in the direction of second end 16. No light refraction or other transmission occurs through threads 46 due to the opaqueness of bezel 44, as best seen in FIG. 5.

It can therefore be appreciated that the instant invention can function primarily as an ordinary flashlight when cover 86 is not used. When cover 86, however, is placed over bezel 44, and the flashlight stood on its end, i.e. upon cover 86, the device functions as a very aesthetically appealing night light or other illumination device.

As shown in FIG. 5, light emitted from lamp 26 is reflected by reflective film 88 which lines the interior of cover 86 back through hollow cavity 18 and body 12 toward second end 16 of the flashlight in a very efficient manner because the light energy has no other place to go. As such, the instant invention provides a highly efficient redirection of light energy when desired toward its second end so as to provide a spectacular illuminated night light. Alternatively, the device can be used as an ordinary flashlight when cover 86 is removed.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A combination flashlight and night light device comprising:

a body member having a first end and a second end;

said first end having a light source and a power source therefore situated therein, said light source being at least partially surrounded by an at least partially transparent cowl through which light energy passes, said light source emitting light energy in a first direction, said first end further defining a cavity through which light energy from the light source travels through the cowl in a second direction, where at least a portion of said cowl is located in said body member substantially opposite said first direction and within said body member so as to directly illuminate said second end;

said second end including a generally liquid-tight chamber in which is disposed a decorative liquid.

2. The device of claim 1, further including an aperture defined by said first end of said device through which light energy passes in said first direction when the device is used as a flashlight.

3. The device of claim 2, further including a means for covering said aperture so as to prevent light from passing in the first direction through said aperture and retaining light energy within said flashlight so as to increase the illumination of the second end of the flashlight.

4. The device of claim 3 further comprising a reflective film attached to an interior surface of said means for covering so as to reflect light energy from said first end toward the second end of said device in said second direction when said cover is placed in registry with said aperture.

5. The flashlight of claim 1, further including an opaque covering connected about at least a portion of said first end of said device.

6. The device of claim 4, further including an opaque shroud covering at least a portion of said first end of said device.

7. The device of claim 1, further comprising a plurality of decorative elements disposed within said liquid.

8. A method for providing light, comprising the steps of:

providing a combination flashlight and night light comprised of: a generally hollow body member having a first end and a second end, said first end having a means for providing illumination in a first direction through an aperture at a proximal end of said first end as well as to provide light energy in a second direction, opposite said first direction, to said second end of said device, a substantially transparent cowl wherein at least a portion of said cowl is located in said body member at least partially surrounding a light source of said means for providing illumination through which light energy from said light source passes, a space between the light source and an interior wall of said hollow cavity through which light energy from said light source passes to directly illuminate said second end of said device, and decorative matter within said second end of said device;

providing a means for covering said aperture so as to prevent light energy from said means for providing illumination from passing through said aperture and thereby contain said light energy within said cavity which in turn is directed toward said second end of said device;

standing said device on said cover when said cover is installed about said proximal end of said first end so that said decorative matter becomes illuminated and functions as a light.

9. The method of claim 8, further comprising the step of providing an on\off switch to permit selective energizing and de-energizing of said means for illumination.

10. The method of claim 8, further comprising the step of providing an opaque covering over at least a portion of an external surface of said first end of said device.

11. The method of claim 8, further including the step of providing an opaque cap adapted to be placed about a light beam aperture in said first end of said device.

12. A novelty flashlight, comprising:

a hollow, generally cylindrical, housing member having a first end and a second end and being at least partially covered by and opaque covering;

said first end being of a sufficient diameter to house a means for illuminating including a light source and source of power therefore, and to permit light energy from said light source to pass from said first end to directly illuminate said second end of said housing through a hollow inner cavity defined by said first end;

said means for illuminating further including a substantially transparent, generally U-shaped, cowl at least a portion of which is located within said housing member, supporting the light source in the first end; and said second end sealingly housing a decorative liquid therein.

* * * * *